United States Patent [19]

Mori

[11] Patent Number: 4,833,902

[45] Date of Patent: May 30, 1989

[54] KEY-HOLDER WITH INCORPORATED TELESCOPIC WRITING MEANS

[75] Inventor: Gianluigi Mori, Turin, Italy

[73] Assignee: Erga S.r.l., Turin, Italy

[21] Appl. No.: 141,555

[22] Filed: Jan. 7, 1988

[30] Foreign Application Priority Data

Jan. 22, 1987 [IT] Italy ..... 52876/87[U]

[51] Int. Cl.[4] ..... A47G 29/10

[52] U.S. Cl. ..... 70/456 R

[58] Field of Search ..... 70/456 R, 456 B, 457, 70/458, 459; 401/170; D19/35; D3/61, 62, 64

[56] References Cited

U.S. PATENT DOCUMENTS 3,690,131 9/1972 Davis ..... 70/238

FOREIGN PATENT DOCUMENTS 235720 6/1911 Fed. Rep. of Germany ..... 401/170

1055179 10/1953 France ..... 70/456 R

*Primary Examiner*—Robert L. Wolfe

*Attorney, Agent, or Firm*—Bachman & LaPointe

[57] ABSTRACT

A key-holder with incorporated telescopic writing means comprises a tubular body open at one end and closed at the other by means of a plug which carries key restraining means; into the tubular body there being threadable a writing means formed by a plurality of tubular frustoconical members mutually threaded telescopically in order to be compacted within said body; within this latter there being provided projections/-grooves capable of cooperating with respective grooves/projections of the writing means in order to restrain it, in a manner releasable by pulling, within the body itself at the end of the compacting of the telescopic members forming said writing means.

4 Claims, 1 Drawing Sheet

KEY-HOLDER WITH INCORPORATED TELESCOPIC WRITING MEANS

This invention relates to a key-holder with an incorporated telescopic writing means.

It is an object of the invention to provide a key-holder which carries a telescopic writing means (a ball pen, a pencil . . . ) so that said writing means, when not used requires very reduced space, while It assumes the conventional dimensions when it is releated from the key-holder for being used.

It is another object of the invention to provide a device having the above characteristics and being at the same time of easy construction and of low production cost.

To attain these and further objects which will be understood better from the following description, the invention proposes to provide a key-holder with incorporated telescopic writing means, characterired in comprising a tubular body open at one end and closed at the other by means of a plug which carries means for restraining the keys; into the the tubular body there being threadable a writing means formed by a plurality of tubular frustoconical members mutually threaded telescopically in order to be compacted within said body; within this latter there being provided projections/-grooves capable of cooperating with respective grooves/projections of the writing means in order to reatrain it, is a manner releasable by pulling within the body itself at the end of the compacting of the telescopic members which form said writing means.

Figure 1:
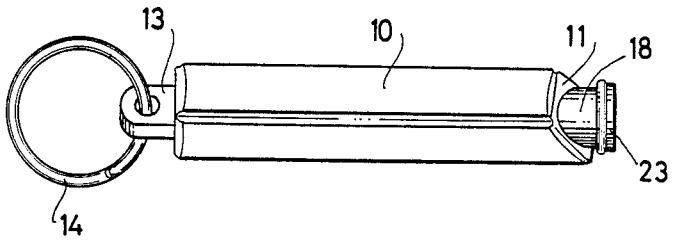
Figure 2:
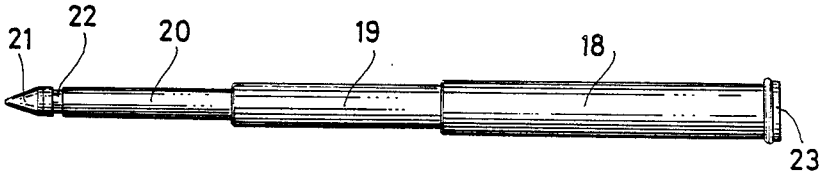
Figure 3:
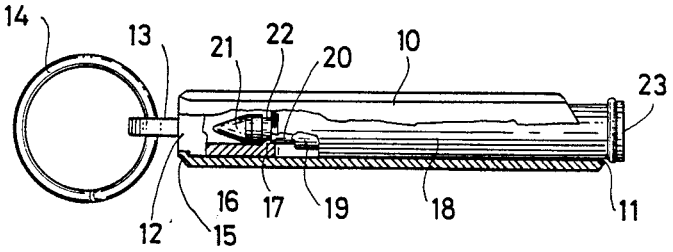

The device according to this invention is now described hereinafter with reference to the annexed drawings, in which:

FIG. 1 is a view of the key-holder into which there is inserted the telescopic writing means, FIG. 2 is a view of the telescopic writing means withdrawn from the key-holder, FIG. 3 is a partially sectional view of the key-holder shown in FIG. 1.

The key-holder according to the invention has a hollow body 10 open at one end and closed at the other end by means of a plug 12. This latter is provided, for example, with a drilled appendix 13 into which a ring 14 is threaded which carries the keys (not shown).

The plug 12 is, for example, of the type which is threaded into the body 10 from the open end 11 and is restrained in a larger inner section 15 provided on the opposite end of the body 10.

Plug 12 is always provided with a tubular portion 16 having an inner annular projection. The writing means, instead, is formed by three or more frustoconical tubular portions 18, 19 and 20 with the refill 21 projecting from the portion 20 of smaller cross-section.

Formed on said portion 20 is a groove 22 intended to be connected to the annular projection 17 of the plug 12.

When threading the writing means into the body 10, the telescopic portions 19 and 20 penetrate till end of stroke into the larger portion 18, and thereafter by further pushing onto the bottom 23 of the writing means the refill 21 is caused to penetrate into the tubular body 16 of the plug 12 until its groove 22 engages the projection 17 of said body 16.

Thus, the writing means is locked in the body 10 of the key-holder, and if a light interference is performed between the end 11 of the body 10 and the frustoconical portion 18, also this latter, after having been threaded to the bottom into the body 10, remains firm on this latter.

It will, however, be sufficient to pull the portion 18 outwardly to withdraw it from the body 10, stretch first the telescopic portions 20, 19 and 18 and then withdraw the entire the already elongated writing means by withdrawing its groove 22 by a pulling action from the projection 17 of the plug.

I claim:

1. In combination a key-holder having a writing mechanism incorporated therein comprising: a hollow tubular body having an open end and a closed end, said closed end having key restraining means; a writing mechanism received in said hollow tubular body, said writing mechanism comprising a plurality of tubular sections telescopically received one within another wherein one of said plurality of tubular sections is provided with engagement means for engaging securing means within said hollow tubular body for releasably securing said writing mechanism within said hollow tubular body.

2. A key-holder according to claim 1 wherein the tubular section of said plurality of tubular sections received within the other tubular sections is provided with said engagement means.

3. A key-holder according to claim 2 wherein said engagement means comprises a groove and said securing means comprises a tongue.

4. A key-holder according to claim 1 wherein said closed end is closed by a plug formed by a base which restrainedly locks itself in the body of the key-holder and is provided with a tubular appendix suitable for contacting the refill of the writing means, carried by one of the telescopic members.

* * * * *